US007156163B2

(12) United States Patent
Heng-I et al.

(10) Patent No.: US 7,156,163 B2
(45) Date of Patent: Jan. 2, 2007

(54) COMPOSITE HEAT EXCHANGER

(75) Inventors: Lin Heng-I, Taipei Hsien (TW); Chuang Feng-Ming, Taipei Hsien (TW); Lin Wen-Hsien, Taipei Hsien (TW)

(73) Assignee: Liung Feng Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 10/968,936

(22) Filed: Oct. 21, 2004

(65) Prior Publication Data

US 2006/0086488 A1 Apr. 27, 2006

(51) Int. Cl.
*F28D 1/047* (2006.01)

(52) U.S. Cl. ..... 165/151; 165/150

(58) Field of Classification Search ..... 165/150, 165/151, 173

See application file for complete search history.

(56) References Cited

U.S. PATENT DOCUMENTS

| | | | | |
|---|---|---|---|---|
| 3,780,799 | A * | 12/1973 | Pasternak | 165/150 |
| 6,591,627 | B1 * | 7/2003 | Rollins | 165/173 |
| 6,842,342 | B1 * | 1/2005 | Lin | 361/710 |
| 2002/0023744 | A1 * | 2/2002 | Kim et al. | 165/151 |
| 2003/0159814 | A1 * | 8/2003 | Sin et al. | 165/151 |

* cited by examiner

*Primary Examiner*—Leonard R. Leo
(74) *Attorney, Agent, or Firm*—Troxell Law Office PLLC

(57) ABSTRACT

A composite heat exchanger having functions of air cooling and spray cooling, includes two base plates, a fin group between the base plates, and a flow conduit. The fin group includes a plurality of fins. Each fin is defined with a plurality of receiving holes. The flow conduit parallelly extends through the receiving holes and surrounds an outside of the fins whereby the outside surface of the flow conduit surrounding the fins directly contacts atomized heat exchange media for heat transfer through phase change.

1 Claim, 3 Drawing Sheets

COMPOSITE HEAT EXCHANGER

BACKGROUND OF THE INVENTION

1. Field of the Invention

The present invention relates to a heat exchanger, and particularly to a composite heat exchanger having functions of air cooling and spray cooling thereby enhancing heat transfer efficiency.

2. Prior Art

As it is well known, air coolers are used to provide us comfortable living conditions thereby helping us to live through a hot summer. The diffusion rate of air coolers is about 85.9% of domestic users. Electricity consumption of air coolers occupies about 30% during electricity consumption peak of summer, which shows that air coolers consume a great amount of electric energy. For saving energy and increasing efficiency of electricity consumption, it is desired to increase energy efficiency ratio (EER) of air coolers. U.S. Pat. Nos. 5,946,932, 4,672,817, 6,598,862, and 6,766,655 and Taiwan Patent No. 367033 disclose different heat exchangers of air coolers for encountering the above problem.

As shown in FIGS. 1–2, a conventional heat exchanger having a plurality of fins is designed to exchange heat with air as the heat exchange medium and so has a function of air cooling. The heat transfer rate of the heat exchanger depends on area of the fins 5 and air flow velocity. However, by using the air cooling type heat exchanger as condenser of the air cooler causes water to drop from it, which is inconvenient to use.

SUMMARY OF THE INVENTION

Accordingly, an object of the present invention is to provide a composite heat exchanger which has functions of air cooling and spray cooling for enhancing heat transfer rate thereof and is applied to a condenser of an air cooler for increasing energy efficiency ratio (EER) of the air cooler and preventing condensed water from dropping from the air cooler, since condensed water is atomized as the heat exchange media and evaporated during the heat transfer process.

To achieve the above-mentioned object, a composite heat exchanger in accordance with the present invention having functions of air cooling and spray cooling, includes two base plates, a fin group between the base plates, and a flow conduit. The fin group includes a plurality of fins. Each fin is defined with a plurality of receiving holes. The flow conduit parallelly extends through the receiving holes and surrounds an outside of the fins whereby the outside surface of the flow conduit surrounding the fins directly contacts atomized heat exchange media for heat transfer through phase change.

Wherein each fin of the fin group is further defined with a plurality of recesses, and the flow conduit extends through the receiving holes and recesses of the fin and is exposed to the recesses.

Other objects, advantages and novel features of the present invention will be drawn from the following detailed embodiment of the present invention with attached drawings, in which:

DESCRIPTION OF THE PREFERRED EMBODIMENTS

Figure 3:
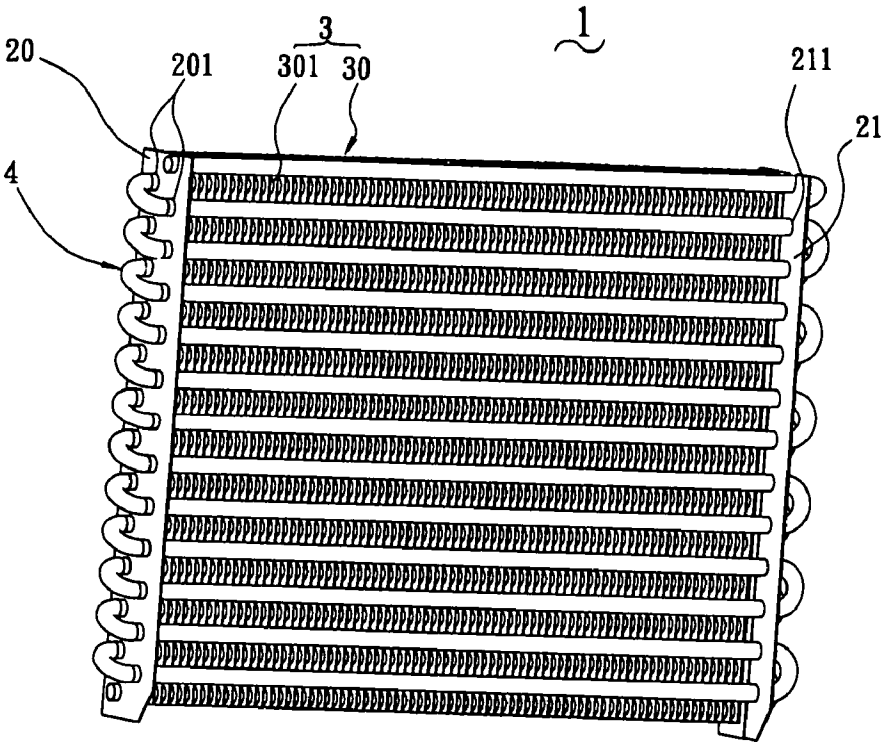

Referring to FIG. 3, a composite heat exchanger 1 in accordance with a first embodiment of the present invention includes two base plates 20, 21, a fin group 3 and a flow conduit 4. The two base plates 20, 21 are respectively defined with a plurality of through holes 201, 211 which are even spaced from each other for extension of the flow conduit 4. The fin group 3 includes a plurality of fins 30. Each fin 30 is defined with a plurality of even spaced receiving holes 301. The flow conduit 4 parallelly extends through the receiving holes 301 and the through holes 201, 211 of the base plates 20, 21. The flow conduit 4 surrounds an outside of the fins 30 whereby the outside surface of the flow conduit 4 directly contacts atomized heat exchange media thereby realizing phase-changed heat transfer process. When the composite heat exchanger 1 of the present invention is applied to a condenser (not shown) of a window type air cooler, the air cooler simultaneously dissipates heat through air cooling and spray cooling with evaporation of the atomized liquid which is the condensed water of the air cooler, thereby enhancing heat transfer rate of the heat exchanger for increasing the EER of the air cooler and preventing condensed water from dropping from the air cooler.

Figure 2:
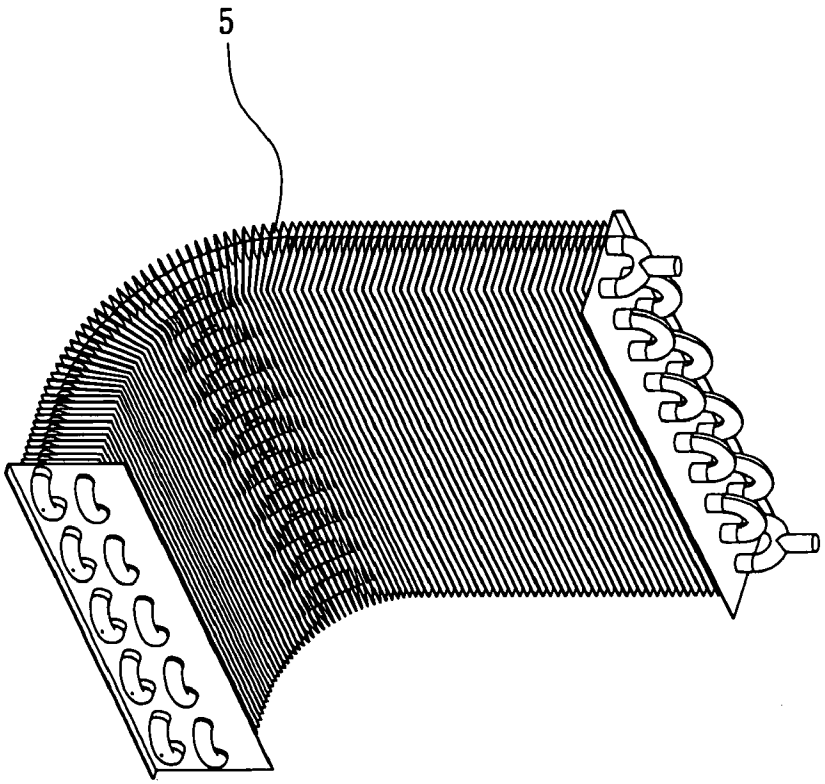
FIG. 2(Prior Art)
FIGS. 1 and 2 are perspective views of conventional heat exchangers.
Figure 1:
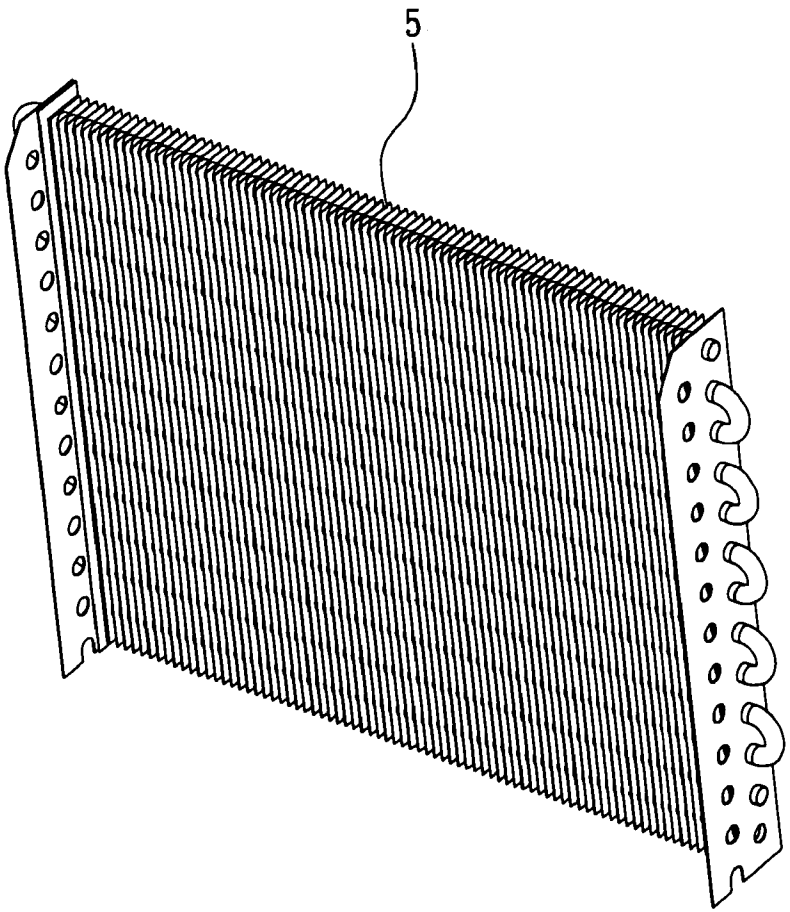
FIG. 1(Prior Art)
Figure 4:
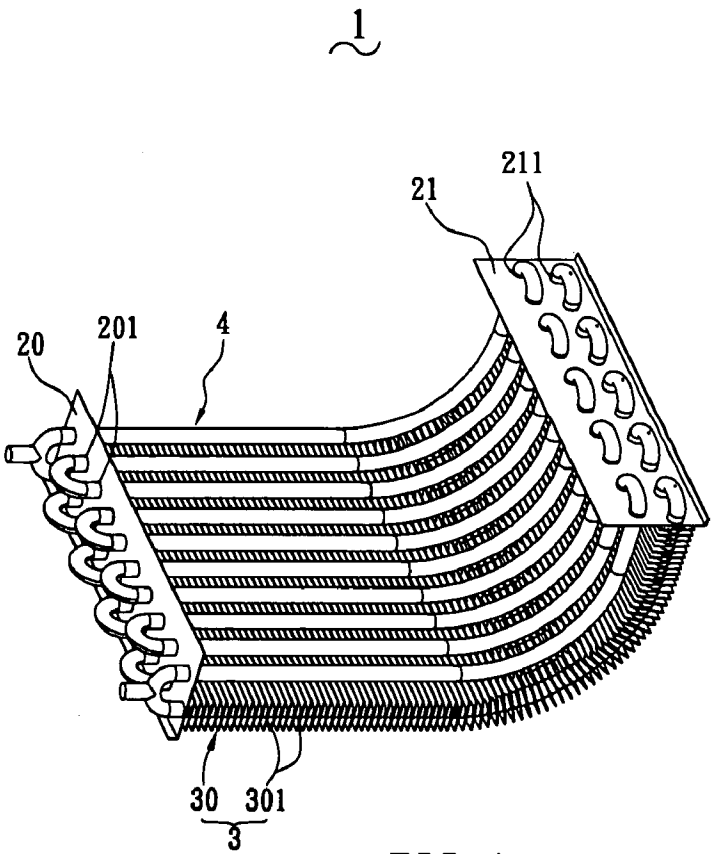
FIGS. 3 and 4 are perspective views of composite heat exchangers in accordance with a first embodiment of the present invention.

Referring to FIG. 4, another composite heat exchanger 1 in accordance with the first embodiment of the present invention includes two base plates 20, 21, a fin group 3 and a flow conduit 4. Each base plate 20, 21 is defined with a plurality of even spaced through holes 201, 211 for extension of the flow conduit 4. Each fin 30 is defined with a plurality of even spaced receiving holes 301. The flow conduit 4 is bent at one side thereof for being applied to a split-type air cooler thereby increasing EER of the split-type air cooler and preventing condensed water from dropping from the split-type air cooler.

Figure 5:
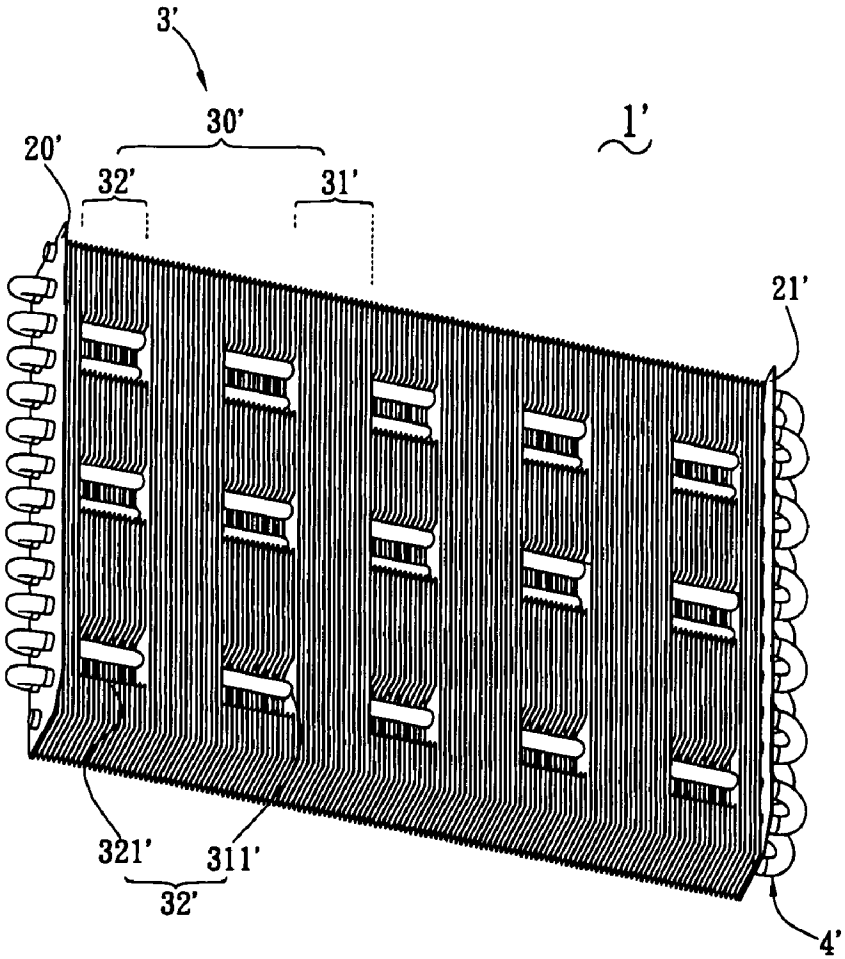
FIGS. 5 and 6 are perspective views of composite heat exchangers in accordance with a second embodiment of the present invention.

Referring to FIG. 5, a composite heat exchanger 1' in accordance with a second embodiment of the present invention for being applied to a window type air cooler includes two base plates 20', 21', a fin group 3' and a flow conduit 4'. The fin group 3' includes a plurality of fins 30'. For easy description, the fins 30' are respectively designated to first fins 32' with a plurality of recesses 321' respectively defined in one side thereof and second fins 31' with a plurality of receiving holes 311' respectively defined towards the corresponding recesses 321'. The fins 31', 32' are even spaced and in an interleaving arrangement. Therefore, after the flow conduit 4' extends through the receiving holes 311' and the recesses 321' of the fins, part of the flow conduit 4' extending through the recesses 321' is exposed. Of cause, the length of the exposed flow conduit 4' can be changed according to the actual demand for adjusting heat transfer rate. Thus, the composite heat exchanger can increase the EER of the window type air cooler and prevent condensed water from dropping from the air cooler.

Figure 6:
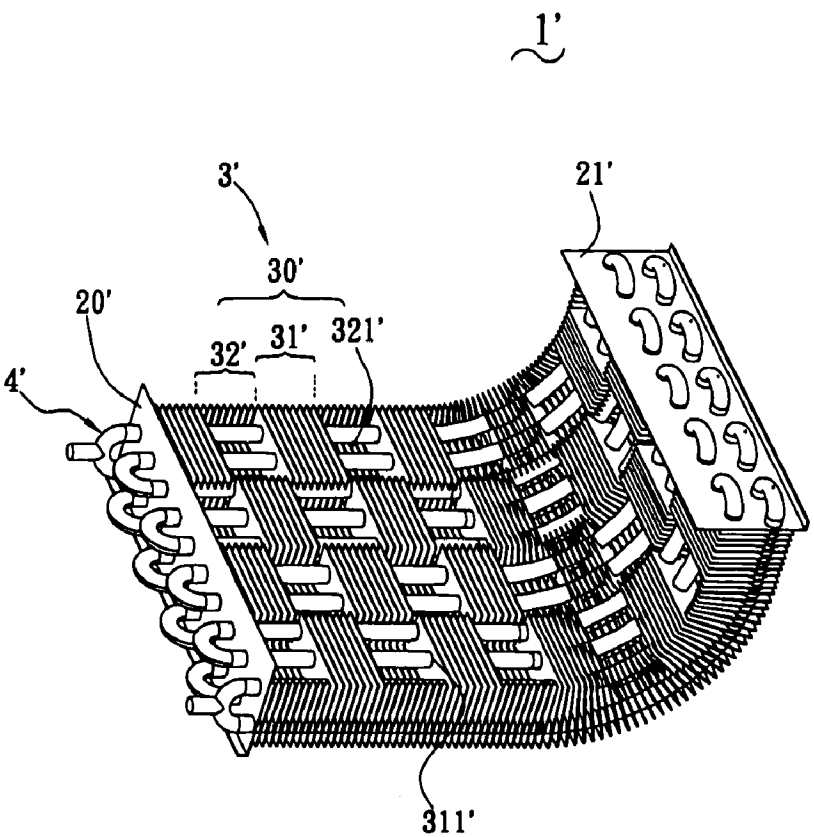

Referring to FIG. 6, another composite heat exchanger 1' in accordance with the second embodiment of the present invention for being applied to a split-type air cooler includes two base plates 20', 21', a fin group 3' and a flow conduit 4'. The fin group 3' includes a plurality of fins 30'. For easy description, the fins 30' are respectively designated to first fins 32' with a plurality of recesses 321' respectively defined in one side thereof and a plurality of receiving holes 311' defined therein, and second fins 31' with a plurality of receiving holes 311' respectively defined towards the corresponding recesses 321' of the first fins 32' and a plurality of recesses 321' defined in one side thereof and towards the corresponding receiving holes 311' of the first fins 32'. The fins 31', 32' are even spaced and in an interleaving arrangement. Therefore, after the flow conduit 4' extends through the receiving holes 311' and the recesses 321' of the fins, part of the flow conduit 4' extending through the recesses 321' is exposed. The flow conduit 4' is bent at one side thereof. Thus, the composite heat exchanger 1' can increase the EER of the split-type air cooler and prevent condensed water from dropping from the air cooler.

It is understood that the invention may be embodied in other forms without departing from the spirit thereof. Thus, the present examples and embodiments are to be considered in all respects as illustrative and not restrictive, and the invention is not to be limited to the details given herein.

The invention claimed is:

1. A composite heat exchanger comprising:

two base plates, a fin group between the base plates, and a flow conduit, the fin group comprises a plurality of fins, each fin is defined with a plurality of receiving holes; and the flow conduit parallelly extends through the receiving holes and surrounds an outside of the fins whereby the outside surface of the flow conduit surrounding the fins directly contacts atomized heat exchange media for heat transfer through phase change, wherein the fin group comprises a plurality of first and second fins which are even spaced and in an interleaving arrangement, the first fins are respectively defined with a plurality of recesses in one side thereof, the second fins are respectively defined with a plurality of receiving holes towards the corresponding recesses of the first fins, and the flow conduit extends through the receiving holes and the recesses of the fins and is exposed to the recesses.

* * * * *